United States Patent [19]

Hopkinson

[11] 4,215,818

[45] Aug. 5, 1980

[54] INDUCTION CHARGING ELECTROSTATIC SPRAYING DEVICE AND METHOD

[75] Inventor: Peter R. Hopkinson, Fulwood, England

[73] Assignee: National Research Development Corporation, London, England

[21] Appl. No.: 938,875

[22] Filed: Sep. 1, 1978

[30] Foreign Application Priority Data

Sep. 20, 1977 [GB] United Kingdom ..... 39143/77

[51] Int. Cl.[2] ..... B05B 5/04

[52] U.S. Cl. ..... 239/3; 239/703; 427/27; 427/31

[58] Field of Search ..... 361/225-228; 118/626; 427/4, 27, 31; 239/3, 690, 695, 699-706, 214.21, 214.25, 223, 224

[56] References Cited

U.S. PATENT DOCUMENTS

| | | | |
|---|---|---|---|
| 2,901,177 | 8/1959 | Norris | 239/703 |
| 3,121,533 | 2/1964 | Sedlacsik, Jr. | 239/703 |
| 4,004,733 | 1/1977 | Law | 239/3 |
| 4,009,829 | 3/1977 | Sickles | 239/705 |

FOREIGN PATENT DOCUMENTS

| | | | |
|---|---|---|---|
| 248444 | 12/1963 | Australia | 239/703 |
| 665655 | 1/1952 | United Kingdom . | |
| 891342 | 3/1962 | United Kingdom . | |
| 1202117 | 8/1970 | United Kingdom . | |
| 1268391 | 3/1972 | United Kingdom . | |
| 1303625 | 1/1973 | United Kingdom . | |
| 1326173 | 8/1973 | United Kingdom . | |
| 1335071 | 10/1973 | United Kingdom . | |

*Primary Examiner*—Andres Kashnikow

*Attorney, Agent, or Firm*—Cushman, Darby & Cushman

[57] ABSTRACT

Electrostatic spraying apparatus employs a concealed electrode at a low potential (relative to that used in conventional apparatus) to form an induced charge on a thin layer of liquid. Subsequent mechanical atomization of the charged layer produces a spray of charged droplets. The thin layer is produced by centrifugally spreading an inlet flow and atomization may also be achieved by rotation. An air flow is arranged to sweep the charged droplets out of the field of the electrode and a baffle, in which the electrode is embedded, is formed to control the direction of emergence of the spray from the nozzle.

10 Claims, 4 Drawing Figures

INDUCTION CHARGING ELECTROSTATIC SPRAYING DEVICE AND METHOD

Figure 1:
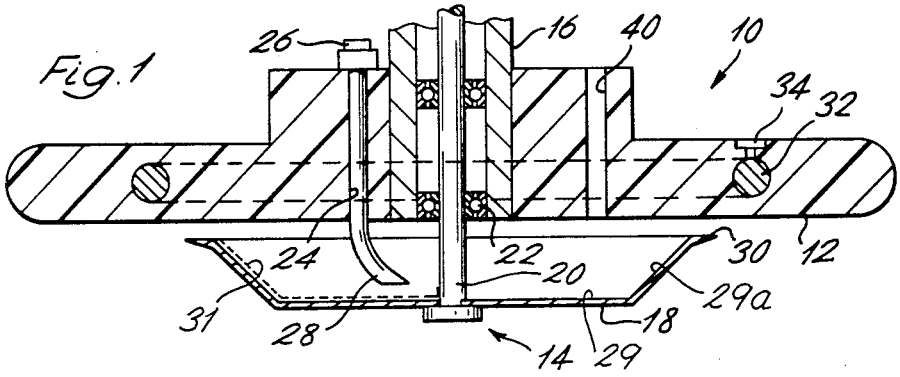

The invention relates to apparatus for electrostatic spraying particularly for the production of electrostatically charged liquid droplets for application to growing crops.

It is now well-known that insecticides and other materials for application to the foliage of plants in a spray of liquid solution or suspension can be more effectively and economically used if the droplets are electrically charged. Because the moisture content of a growing plant causes the leaf surface to be effectively at earth potential the particular advantage arises that a charged droplet may as easily be attracted to the normally inaccessible under-surfaces of the leaves as to the upper surfaces. The spray must usually be delivered with a sufficient directional velocity to enable the area of deposition to be controlled in the presence of air movement and motion of the spraying vehicle. One approach to the problem has been to employ conventional types of electrostatic spray nozzle in which the liquid is atomised by air or hydraulic pressure. Charging is commonly achieved by producing the spray in a high-voltage ionising field or at a high-voltage electrode, the voltages employed being typically several tens of kilovolts. The spray liquid is usually conductive and the whole of the liquid in the supply system including a storage vessel of large electrical capacitance rises to a high potential. This constitutes a significant risk to the operator even though the high voltage generator may itself be of a low-current non-lethal design.

The electrification of a liquid spray material is also advantageous in an industrial application such as painting, particularly of an irregular surface. However, the use of high voltage equipment then presents the additional hazard that a paint solvent of low flash-point may ignite or explode if a spark discharge should occur at the nozzle.

It is an object of the invention to provide apparatus of improved safety in which charging is produced by means of a comparatively low-voltage supply.

According to one aspect of the invention there is provided apparatus for electrostatic spraying including a nozzle, the nozzle comprising inlet means for admitting a stream of liquid, distributor means including a first surface arranged to receive the stream of liquid and to distribute the ligand to form a thin layer and a second surface having an edge arranged to receive the thin layer, and electrode means including an induction electrode extending parallel to the edge of the second surface and effective when energised to produce an induced charge on the thin layer of liquid in the region of the edge, and atomiser means effective to cause the charged layer of liquid to be mechanically atomised to produce a spray carrying the induced charge.

The distributor means may comprise means for rotating the first surface such that the liquid is distributed centrifugally or may comprise a stationary member in which the first surface is so disposed that in use the liquid is caused to be distributed under the influence of gravity.

The atomiser means may include means effective to cause atomisation by rotating the second surface, by inducing vibration of the second surface, or by producing a localised flow of air at the second surface. The first and second surfaces may be integral in construction.

The electrode means may comprise an electrode uniformly spaced apart from the edge of the second surface in a plane parallel to the plane of the edge, the electrode being rendered inaccessible to contact by the liquid, and means for external connection of the electrode.

Preferably means is provided to remove charged droplets from the electric field and the atomiser means may be arranged to provide a flow of air which is effective for this purpose.

Additionally or alternatively the electrode means may be arranged to limit the tendency for charged droplets to be trapped in the field.

Thus the electrode means may comprise a pair of electrodes arranged to produce similar field intensities of the same sign at the edge and symmetrically disposed about the direction of emission of the spray from the edge.

In an alternative form the electrode means includes an electrode, arranged to be energised in opposite polarity to the charged droplets and so disposed as to repel the droplets from the region of the charge-inducing-field.

According to another aspect of the invention an electrostatic spraying apparatus comprises a plurality of electrostatic spraying nozzles according to said one aspect of the invention, means for maintaining the nozzles at a predetermined attitude and distance relative to the object to be sprayed, means for providing a stream of liquid to each nozzle, and means for enabling the operation of each nozzle to produce the desired spray.

Crop spraying apparatus may incorporate apparatus according to said another aspect of the invention.

The means for enabling operation of each nozzle may include one or more of rotary drive means, compressed air supply means and vibration energisation means.

According to a further aspect of the invention there is provided a method of electrostatically spraying a liquid comprising the steps of causing the liquid to be distributed in a thin layer over a surface towards an edge of the surface, producing an electric field at the liquid layer in the region of the edge such that inductive charging of the liquid occurs in that region, and causing the charged liquid to be atomised by mechanical means to produce charged droplets.

Reference has been made to the risk involved in operating a high-voltage spraying system of conventional design in the open air and on a moving vehicle where industrial safety precautions cannot easily be applied. Low voltage systems in which a liquid is charged by induction have been known for a number of years for such purposes as ink-jet printing and microtitration. In these applications a fine jet of liquid from a source at earth potential is projected through a charging cylinder so that a capacitor is formed. When a potential is applied to the cylinder a charge of opposite sign is induced on the jet and as the jet breaks up the induced charge is carried away on the droplets. The cross-sectional area of the jet and hence the rate of flow must be sufficiently small for each droplet to become significantly charged and the problem which may be visualised in such an arrangement is to provide satisfactory charging at the rate of flow which is required in a crop sprayer of practical utility.

In seeking a solution to the rate-of-flow problem in the method and apparatus of the present invention no attempt is made to charge a jet. Instead the fluid is distributed in a thin layer (which need not be continuous if the substrate is conductive) and charge is induced over a substantial area at the edge of the layer. In effect, on mechanically atomising the layer, multiple streams of charged droplets are produced simultaneously. The inductive field is such that no useful degree of atomisation is attributable to the electrostatic influence alone.

Figure 2:
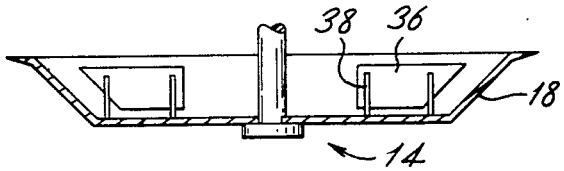
Figure 3:
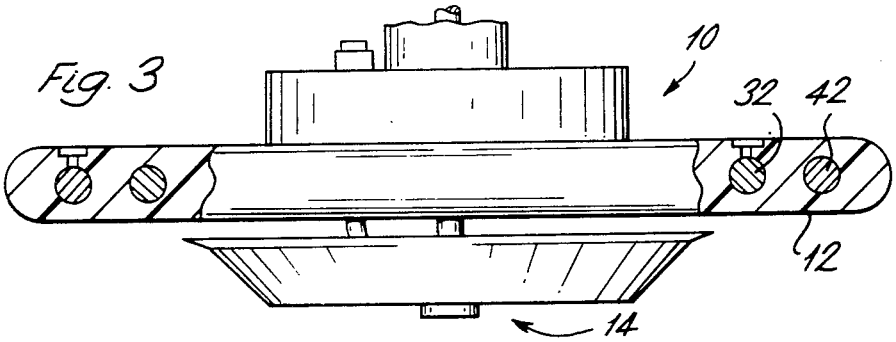
Figure 4:
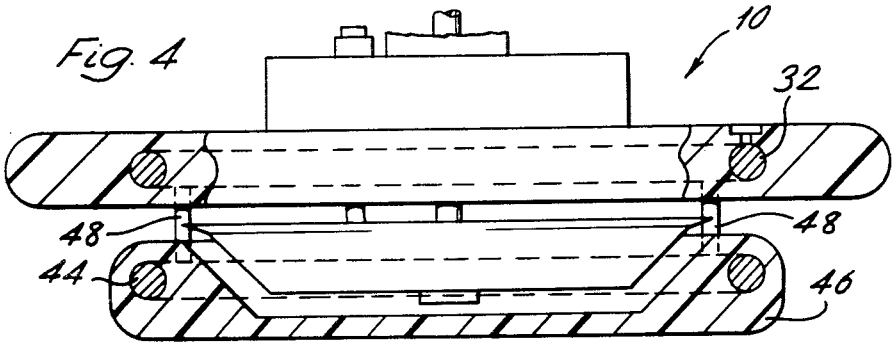

Certain embodiments of the invention will be described with reference to the accompanying drawings in which:

FIG. 1 represents diagrammatically a spraying nozzle in accordance with the invention, FIG. 2 represents diagrammatically a modified portion of the nozzle of FIG. 1, and FIGS. 3 and 4 represent diagrammatically further modified forms of the nozzle of FIG. 1.

Referring to FIG. 1 a spray-nozzle 10 of generally circular symmetry comprises a base 12 and a rotor 14, the base 12 having on one side a central hollow column 16 which extends normally to the plane of the base. The column 16 is arranged to enable the spray-head 10 to be hand-held or to be carried on a spraying vehicle. The rotor 14 comprises a distributor dish 18 mounted in a plane parallel to the base 12 on a spindle 20 which runs in bearing 22 carried in the column 16. The end of spindle 20 within the column 16 is arranged to engage for rotation with a flexible drive shaft (not shown) or other form of drive derived, in the mobile equipment, from the spraying vehicle. A small electric motor could be used for a hand-held equipment. A channel 24 parallel to the axis through the base 12 carries an input connection 26 for the spray liquid which is delivered from a reservoir (not shown) to the dish 18 via a tube 28 which extends from the channel 24 to discharge close to the centre of the dish 18. On rotation of spindle 20 at a suitable speed, liquid is distributed from the centre over a base surface portion 29 of dish 18 to a wall surface portion **29*a* and is atomised on reaching the edge of surface 31 which terminates in a sharp lip 30. The rate of delivery at input 26 is adjusted so that atomisation is continuous and complete. Electrically, it is necessary to provide a charge-leakage path to earth from the edge 30. Normally the liquid used will be sufficiently conductive, a path then being maintained through the pool of liquid in the dish 18 and the spindle 20 providing a metallic earth return via the drive mechanism. Alternatively the column 16 may be made of metal and provided with an earth connection. The dish 18 is conveniently made as a plastics moulding for such conductive liquids; for a non-conductive liquid the dish should be metallic, or provided with at least a metallised track if made from insulating material. The presence of such a track when required is indicated by a broken line 31**.

The base 12 is also conveniently made by moulding, and must be of insulating material, to house in a diametric plane a metal ring 32 of diameter slightly greater than that of the lip 30. The plane of lip 30 and the adjacent surface of ring 32 are then separated by a few mm, the lip 30 being spaced one or two mm from the base 12. A connecting point 34 on ring 32 is arranged for the attachment or insertion of a connector (not shown) for a high voltage cable. The connector must be shrouded and the connection made in such a way that it cannot be unintentionally detached in normal use. The ring 32 is so moulded or embedded in the base 12 as to be shielded from contact with the liquid supply or with the operator. Thus no part of the spraying system which can be touched by the operator is at high voltage and the circuit contains no significant capacitance.

In operation the nozzle is connected to a compact low-current d.c. power supply (not shown) having a selectable output voltage of maximum value substantially less than 10 kV. Liquid is distributed in a thin layer to the lip 30 where it is exposed to the electric field produced in the gap between the ring 32 and the lip 30. Ring 32 is preferably made circular in cross-section so that within the material of the base 12 the field remains low but in the region of the sharp edge of the lip 30 the field is more concentrated. The liquid layer in this region thus becomes charged by induction so that on separation of the surface particles of the layer from the bulk by mechanical atomisation such particles carry a charge opposite in sign to that of the ring 32. The charged liquid particles will then be attracted towards the ring 32 but will ideally be carried away from the charging region by the combined effect of the centrifugal force and the air disturbance caused by rotation of rotor 14.

The base 12 is indicated in FIG. 1 as having a planar face over its whole diameter. This shape will allow a radial dispersion of the spray from rotor 14 and may be appropriate for some applications. In other cases some form of shrouding to divert the spray in an axial direction will be used. The spray-head 10 is intended to be used so that the distributor dish 18 is substantially horizontal but the centrifugal effect enables an effectively uniform distribution to be obtained during significant angular deviations from the horizontal.

FIG. 2 illustrates a modification to the rotor 14 of Figure in which the distributor dish 18 carries one or more vanes 36 within the dished portion. The vanes 36 are mounted on legs 38 to avoid interference with the flow of liquid over the surface of the dish 18 while presenting sufficient surface area to enable a strong outflow of air from the gap between the rotor 14 and the base 12 to be produced on rotation. An air inlet channel 40 is provided through the base 12. The outflow can be directed to further control the spray distribution but also reduces the possibility that charged droplets released from the edge 30 will be trapped in the electric field and will condense on the undersurface of the base 12 in the region of the electrode 32.

As an alternative to the provision of vanes 36 an inlet connection (not shown) can be provided to channel 40 in the base 12 for coupling to an external supply of compressed air which is then released in the space between the dish 18 and the base 12.

An alternative or additional means of diverting charged particles from the surface of base 12 is to embed a second ring electrode 42 in the rim of base 12 as is indicated in FIG. 3. The ring 42 is similar to the ring 32 but of larger diameter and is maintained at a similar value of voltage of opposite polarity. Since the field at the lip 30 due to ring 32 is partially counteracted by the field due to ring 42, the voltage applied to ring 32 must be made correspondingly greater than when ring 42 is absent. Provided that charged droplets are carried past the immediate region of ring 32 they will then be repelled from the base 12 by the field due to ring 42. Rings 32 and 42 may be co-planar as shown in FIG. 3. In a modified form (not shown) of the structure of FIG. 3, the rim of base 12 is flared downwards to surround rotor 14 to the extent required to produce a desired distribution of spray. The plane of ring 42 will then be displaced parallel to the plane of ring 32.

FIG. 4 illustrates a further means of controlling the path of charged droplets from the rotor 14. The structure is identical to that of FIG. 1 with the addition of a ring electrode 44 similar to ring 32 which is embedded in an insulating carrier 46 and suspended below the rotor 14 from base 12. Ring 44 is required to be held at the same potential as ring 32 so that the suspension conveniently comprises three rigid insulated wires 48 connected between rings 32 and 44 to hold them parallel. Carrier 46, in the form illustrated, comprises a dish which conforms generally to the profile of rotor 14. Ring 44 can thus be located so that the two rings are in approximate symmetry about the edge 30 of rotor 14. The resultant field at the edge 30 is then substantially radial and charged droplets will tend to travel in this direction without interception by the surface of base 12 or carrier 46. A simple annular moulding is adequate to provide insulation for ring 44 but the dished form of carrier 46 also serves as a shield for the rotor 14.

It is thought that in any of the embodiments described some loss of charge from the droplets to surfaces such as the base 12 and carrier 46 will always occur and that the materials of these surfaces should be very slightly conductive, sufficient to prevent the accumulation of surface charge.

The flow rate of the nozzles of FIGS. 1, 3 and 4 is determined partly by the diameter of rotor 14 which is in turn related to the required width of the spray path. When the flow rate from a single rotor is insufficient, however, the structural principle of FIG. 4 can be extended to provide further rotors on spindle 20, each having an associated electrode and carrier in the manner of ring 44 and carrier 46. A conduit is arranged for the supply of liquid to each rotor.

The invention has been described with reference to a centrifugal system of liquid distribution and atomisation. However, the advantage of efficient charging by induction is intended to be realised with any arrangement for distributing liquid thinly and uniformly over a sharp edged surface at which it can be subjected to a suitable field prior to atomisation by mechanical means.

For example the liquid may be allowed to flow over a static conical surface having a vertical axis with apex uppermost or over an inclined planar surface. Such surfaces should carry shallow channels as an aid to uniformity of distribution. In each case atomisation can be arranged to occur at the lower edge by the operation for example of a suitable vibration mechanism or by directing jets of air from an inlet such as the inlet 40 to impinge on the edge. An appropriate ring or linear electrode is arranged to provide the required electric field at the edge.

It will also be apparent that the stages of formation of the thin layer of liquid and the subsequent atomisation are discrete and can be physically separated by providing two surfaces. In the embodiments described the initial distribution surface 29 and the surface 29*a* which includes the edge at which atomisation occurs have been constructed integrally in the dish 18. In particular circumstances however it may be advantageous for example to feed a high-speed rotary atomiser from a stationary or low speed rotary distribution surface instead of directly from the liquid input pipe. For any such arrangement a charge leakage path must be provided from the liquid layer at the atomisation edge.

In the practical utilisation for crop-spraying of any of the forms of spray-nozzle within the scope of the invention, the probable arrangement includes a plurality of spray-nozzles mounted on a boom carried by a mobile-spraying vehicle so as to maintain substantially a predetermined distance from and attitude with respect to a growing crop. All necessary services would be carried by the vehicle and the conditions of spraying (such as rate of flow, air pressure and charging voltage) would be determined with reference to the atmospheric conditions and the state of growth of the crop in a preliminary test.

In use for paint-spraying under controlled conditions of manual or automatic operation it is anticipated that ideal values for the spray parameters need be determined only once for each type of work.

I claim:

1. A method for the electrostatic spraying of a liquid comprising the steps of distributing the liquid in a thin layer, exposing the layer to an electric field by means of an electrode embedded in a molded insulating member, providing a charge flow path from the layer such that inductive charging of the liquid occurs and causing the charged liquid to be atomized by mechanical means to produce a spray of charged droplets, disposing said insulating member so as to substantially determine the direction of emergence of said spray.

2. Apparatus for electrostatic spraying including a nozzle, the nozzle comprising:

inlet means for admitting a stream of liquid;

distributor means including a first surface arranged to receive the stream of liquid and to distribute the liquid to form a thin layer and a second surface having an edge arranged to receive the thin layer;

electrode means including an induction electrode extending parallel to the edge of the second surface and effective when energized to produce an induced charge on the thin layer of liquid in the region of the edge;

atomizer means effective to cause the charged layer of liquid to be mechanically atomized to produce a spray carrying the induced charge; and baffle means including a molded insulating portion in which the induction electrode is embedded with means for external connection, the baffle means being spaced apart from the distributor means and so arranged and disposed as to substantially determine the direction of emergence of the atomized spray from the nozzle.

3. Apparatus according to claim 2 in which the distributor means comprises means for rotating the first surface such that the liquid is distributed centrifugally.

4. Apparatus according to claim 3 in which the distributor means includes means for producing a flow of air effective to remove the charged spray from the region of the induction electrode.

5. Apparatus according to claim 2 in which the atomiser means includes means for rotating the second surface at a rate effective to cause atomisation.

6. Apparatus according to claim 2 in which the atomiser means includes means for producing a localised flow of air at the second surface effective to cause atomisation.

7. Apparatus according to claim 2 in which the first and second surfaces are integral in construction.

8. Apparatus according to claim 2 in which inductive charging is enabled by means of a charge flow path from the liquid layer comprising a conductive track applied to the distributor surface.

9. Apparatus according to claim 2 in which the electrode means comprises a further electrode arranged to be energised in opposite polarity to the charge carried by the spray and so disposed as to repel the spray from the region of the charge-inducing field.

10. Apparatus according to claim 2 in which the electrode means comprises a further electrode similarly embedded in insulating material and of similar polarity, the electrodes being symmetrically disposed about the direction of emission of the spray from said edge.

* * * * *